United States Patent [19]

Page

[11] 4,298,051

[45] Nov. 3, 1981

[54] METHOD OF DIE CASTING UTILIZING EXPENDABLE SAND CORES

[75] Inventor: Enno H. Page, Toledo, Ohio

[73] Assignee: NL Industries, Inc., New York, N.Y.

[21] Appl. No.: 78,794

[22] Filed: Sep. 25, 1979

Related U.S. Application Data

[63] Continuation-in-part of Ser. No. 909,468, May 25, 1978, abandoned.

[51] Int. Cl.[3] ..... B22C 3/00; B22C 9/10; B22D 17/20

[52] U.S. Cl. ..... 164/72; 106/38.27; 106/38.3; 164/113; 164/138

[58] Field of Search ..... 164/14, 41, 72, 113, 164/138; 106/38.3, 38.35, 38.9

[56] References Cited

U.S. PATENT DOCUMENTS

| | | | |
|---|---|---|---|
| 3,923,525 | 12/1975 | Toeniskoetter et al. | 106/38.3 |
| 3,930,872 | 1/1976 | Toeniskoetter et al. | 106/38.3 |
| 3,968,828 | 7/1976 | Toeniskoetter et al. | 164/41 |
| 4,001,468 | 1/1977 | Skubon et al. | 427/134 |
| 4,070,195 | 1/1978 | Toeniskoetter et al. | 164/41 X |
| 4,089,692 | 5/1978 | Toeniskoetter et al. | 106/38.9 X |
| 4,096,293 | 6/1978 | Skubon et al. | 427/134 |
| 4,127,157 | 11/1978 | Gardikes et al. | 164/113 X |
| 4,209,056 | 6/1980 | Gardikes et al. | 106/38.3 X |
| 4,226,626 | 10/1980 | Toeniskoetter et al. | 106/38.35 |

FOREIGN PATENT DOCUMENTS

| | | | |
|---|---|---|---|
| 1199673 | 7/1970 | United Kingdom | 164/113 |

*Primary Examiner*—Robert L. Spruill
*Assistant Examiner*—J. Reed Batten, Jr.
*Attorney, Agent, or Firm*—Gerald K. White; Eugene Striffler; Gary M. Nath

[57] ABSTRACT

Coated sand cores containing a boronated aluminum phosphate binding agent are used in the production of die castings having undercut regions because of the favorable combination of shakeout properties, resistance to washout, and resistance to surface penetration.

7 Claims, 1 Drawing Figure

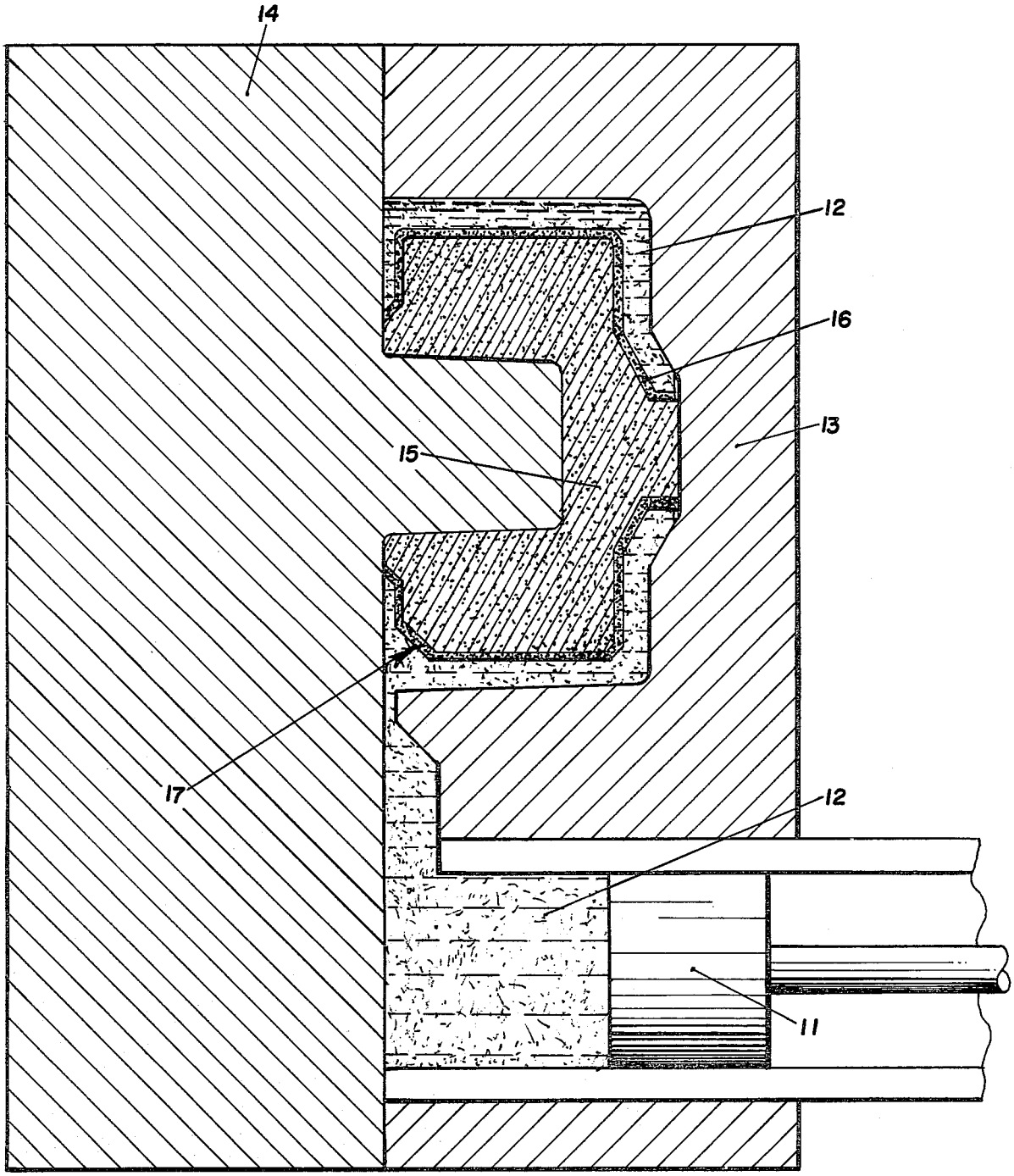
14
12
16
13
15
17
12
11

METHOD OF DIE CASTING UTILIZING EXPENDABLE SAND CORES

This application is a continuation-in-part of copending application Ser. No. 909,468 filed May 25, 1978 now abandoned.

The invention relates to the art of die casting such metals as aluminum, zinc, magnesium, copper, and their alloys and to a solution to a long standing problem therein; i.e., the lack of a commercially feasible die casting technique to produce castings having undercut regions. Traditional pressure die casting requires molds or dies which are able to withstand the high temperatures and pressures to which they are subjected. Thus, ferrous materials are commonly used for die casting molds. Because these die materials are not easily collapsible, complex undercuts and reliefs are not possible because of the lack of ability to remove the casting from the mold. Other common forms of casting, such as sand and semipermanent mold, have employed expendable or disposable cores because the pressure requirements are usually under the order of 30 psia as compared with about several thousand psia needed for high pressure die casting. The lower pressure has allowed the development and use of fragile disposable cores for many years in these two casting processes. A typical core is composed of foundry sand mixed with a binder or resin. Through the use of heat, a catalyst or chemical reaction, the sand grains are bonded together into a discrete shape, and can be used in the casting process. The heat given off during the solidification and cooling of the actual cast parts drives off the moisture, or results in the chemical breakdown of the binder in the core. This permits relatively easy removal of the core from the casting.

Prior art attempts to utilize sand cores for die casting have included the use of glass and soluble salt cores. Such techniques are discussed in detail in British Pat. No. 1,179,241. These systems are considered to be unsatisfactory from the standpoints of process control economics, handling, and the corrosive characteristics of the salts.

The major problem with producing a satisfactory expendable core for use in high pressure die casting has been the inability of a single core/binder system to simultaneously meet three primary core characteristics. These are good shakeout, good washout resistance and freedom from surface penetration. Good shake-out is necessary to facilitate core removal from the casting. Washout resistance is the ability of the core to withstand erosion from the high metal velocities that occur while producing the die casting. Not only does washout adversely affect the tolerances on the finished part, but the sand physically removed becomes embedded within the casting. Surface penetration is caused by the combination of high heat and pressure which breaks down the core surface and permits the metal to penetrate between the sand grains thus causing a sand/metal mixture interface at the surface of the casting. This condition is extremely detrimental to subsequent machining and tool life. Moreover, should the sand become separated from the surface after component installation, damage to related parts, such as the lubrication system of an automobile engine could result. Expendable cores that have been developed in the past either had good shakeout, with high washout and resistance to surface penetration, or good washout and surface penetration resistance with extremely poor shakeout. This invention is considered to solve such problems through the use of a core system having the requisite balance of all three properties.

The FIGURE is a sectional view of a mold portion of a die casting machine and is useful for illustrating regions in the casting in which the three problems discussed above occur. Plunger 11 is used to inject molten metal 12 into the die casting mold formed by steel members 13 and 14 and sand core 15. Note that the final die casting shape includes an undercut region. Surface penetration of metal 12 into sand core 15 occurs along the dark shaded region identified as 16 in the FIGURE. Washout usually occurs at areas such as denoted by 17. Shakeout refers to the ability to remove core 15 upon solidification of the die casting, its removal from the die casting machine, and subsequent cooling to ambient temperature.

It is thus an objective of the invention to provide an expendable core system that is compatible with the high temperatures and pressures involved in die casting so that die castings having undercut regions may be economically produced. Other objectives and advantages will become apparent to those skilled in the art from the following description of the invention.

It has been discovered that expendable sand cores can be used to produce die castings having undercut regions provided that a binding agent comprising boronated aluminum phosphate in an amount from about 3 mole % to about 40 mole % based upon the moles of aluminum and containing a mole ratio of phosphorous to total moles of aluminum and boron of about 2:1 to about 4:1 is used. The binder, mixed with foundry sand, and an appropriate hardening agent forms the core. The core can also be coated to provide improved resistance to penetration and washout.

The boronated aluminum phosphate binding agent described above is more fully described in U.S. Pat. No. 3,930,872 which patent is incorporated by reference herein for such purpose. Specifically, said patent states that the binder comprises a boronated aluminum phosphate containing boron in an amount from about 3 mole % to about 40 mole % based upon the moles of aluminum and containing a mole ratio of phosphorous to total moles of aluminum and boron of about 2:1 to about 4:1; an alkaline earth metal material containing alkaline earth metal and an oxide; and water. This agent has proven to be beneficial to shakeout properties in die casting applications when present in amounts from about 0.3% to 3.5% by weight of foundry sand. It is preferred to employ a range of from about 1.0% to 3.5% when using typical silica foundry sand of a fineness of AFS No. 65. The lower limit is required to provide sufficient core strength to withstand consequent handling while the upper limit should not be exceeded due to blowing problems during coremaking caused by a lack of uniform density related to variations in sand flow and unacceptable decreases in shakeout efficiency. Should heavier foundry sands such as zircon be used, less binder is required, i.e., on the order of from about 0.3% to 1.5%. The respective upper and lower limits are chosen for the same reasons as for silica sands. Of course, the use of other commonly used foundry sands having different densities than the above mentioned sands is within the scope of the invention. Such other sands would require the use of binder amounts consistent with density.

The hardening agent should be present in sufficient quantity to cause the binder to harden and thereby impart the necessary strength to the core to permit handling and placement in the die casting machine without damage. When a hardening agent such as the alkaline earth metal material containing alkaline earth metal and an oxide as discussed in aforementioned U.S. Pat. No. 3,930,872 is utilized in the sand core, an amount ranging between about 10% and 20% of the binder weight should be used. As the amount of the hardening agent mentioned in aforesaid U.S. Pat. No. 3,930,872 decreases bench life increases. However, this beneficial process advantage must be traded off with a loss in shakeout properties and core strength. Other known hardening agents such as ammonia gas are contemplated and would be suitable for use with the sand core of the invention.

Iron oxide in the form of $Fe_2O_3$ may be optionally present in the sand core for purposes of further enhancing hardening and shakeout properties in amounts from about 1% to 4%. $Fe_2O_3$ in amounts greater than about 4% lead to an undesirable loss of core strength.

As also taught in U.S. Pat. No. 3,930,872, water is included in the sand core formulation for the purposes taught in the patent and in an amount from 15% to 50% by weight based upon the total weight of boronated aluminum phosphate and water.

To prepare the expendable core of the invention, one merely needs to thoroughly incorporate the binder, solid hardening agent, and, optionally, the $Fe_2O_3$ into the foundry sand by mixing. Should a gaseous hardening agent be employed rather than a solid agent, the binder and $Fe_2O_3$ are mixed with the sand and then the gaseous hardening agent is passed through the mixture to initiate hardening or curing of the binder.

Following its preparation, the core may be coated to further improve performance with respect to washout and surface penetration. Core coatings generally comprise a suspending agent, a refractory material, a binding agent, and a solvent.

Suspending agents are usually clay or clay derivatives. These materials should be present in amounts sufficient to perform the function of maintaining the refractory material in suspension. Based upon total solids weight, such agents may be present in amounts ranging from about 4% to 30%.

Typical particulate refractory materials that are useful in the coating formulation include but are not limited to graphite, silica, aluminum oxide, magnesium oxide, zircon, and mica. These materials are present in amounts generally ranging from about 60% to 95% based upon total solids weight.

The mass of particles is bound together through use of binding agents such as thermoplastic resins. Binding agents useful in the practice of the invention generally comprise from about 1% to 10% by total solids weight of the coating composition. The binding and suspending agents should be compatible with the particular solvent which may be an organic liquid. The solvent should be included in an amount which is effective to obtain the necessary viscosity to control coating thickness and uniformity.

Core coatings for die castings are more critical than core coatings suitable for other casting methods. The core coating should possess the capability of being able to substantially seal the pores on the surface of the core. Because die casting places molten metal under pressure, any porosity at the surface of the cores will lead to penetration of the molten metal and thus trap sand on the surface of the as-cast part. An application of the proper core coating to the core will provide a die like finish with no resultant penetration of the molten metal into the sand core.

A typically suitable core coating comprises, based upon total solids weight, from 4% to 30% of an amine treated bentonite suspending agent, from 1% to 10% of a thermoplastic resin binding agent, and from 60% to 95% of a refractory such as silica or the like. The above constituents, in powder form, are mixed with a sufficient quantity of organic liquid vehicle to produce the necessary viscosity that will produce, upon drying, the desired coating thickness and seal the pores on the surface of the core.

An additional core coating that has proven to be satisfactory for use in combination with the binding system of the invention is that described in U.S. Pat. No. 4,096,293 which patent is incorporated by reference herein for purpose. Specifically, a coating material having a viscosity sufficient to substantially seal surface porosity of the core and suitable to obtain a coating thickness and uniformity that leads to good resistance to washout and penetration during die casting and consisting of from about 5% to 90% of an organic liquid solvent, from about 0.1% to 2% of a suspending agent, from about 5% to 80% of calcium aluminate particles having an average particle size of 20 to 25 microns and no particles larger than about 70 microns, and a hard resin which is the reaction product of fumaric acid, gum rosin, and pentaerythritol, said resin is within the ratio by weight between about 0.5 and 5 parts per 100 parts of composition, all percentages expressed by weight of composition. A wetting agent may optionally be added in amounts ranging from about 0.01% and 2%.

Following manufacture of the core in a core box and its removal, the core is sufficiently strong enough to be handled. A core coating is then applied by brushing, dipping, spraying or an equivalent method. Once the coating is dry, the core is placed into a die located on a casting machine. The steel portion of the die forms the surface shape of the metal part that is not formed by the core. The core is placed in this die and is located by pins, impressions or other methods commonly known to those skilled in the art. The die is then closed thus trapping the core in a fixed location and molten metal is then injected into the die.

During the process of solidification in the die, heat is emitted from the casting. A portion of the heat flows into the core and increases its temperature. This flow breaks down the binder and drives off any resultant moisture. Once the molten metal has solidified in the die, the machine is opened and the resultant casting and expendable core are removed. Upon cooling to ambient temperature the core may be shaken out mechanically.

The following examples illustrate various embodiments of the invention.

EXAMPLE 1

An aluminum alloy was die cast into the shape shown in the FIGURE with use of a core containing zircon foundry sand (AFS Fineness No. 120), 1.25% by weight of sand of the binder of the invention, 20% of the binder weight of the previously described alkaline earth hardener. The core was coated with two coats of the previously described core coating. Good shakeout properties were noted, upon mechanical separation of the core from the casting upon cooling to ambient temperature.

The casting exhibited good resistance to surface penetration and washout resistance appeared to have been good.

EXAMPLE 2

An aluminum alloy was die cast into a pump part having a serpentine core with use of a core containing silica foundry sand (AFS Fineness No. 65), 2.5% by weight of sand of the binder of the invention, 20% of the binder weight of the previously described alkaline earth hardener. The core was coated with two coats of the previously described core coating. Good shakeout properties were noted upon mechanical separation of the core from the casting upon cooling to ambient temperature. The casting exhibited good resistance to surface penetration and washout resistance appeared to have been good.

It is claimed:

1. A method for forming a die casting having an undercut region from molten metal, comprising: injecting molten metal into a die casting mold having a casting surface that includes at least one expendable sand core that forms an undercut region on said die casting, said core consisting essentially of from about 0.3% to 3.5% by weight of foundry sand of a binder consisting essentially of a boronated aluminum phosphate containing boron in an amount from about 3 mole % to about 40 mole % based upon the moles of aluminum and containing a mole ratio of phosphorous to total moles of aluminum and boron of about 2:1 to about 4:1, an effective amount of a hardening agent to react with the aluminum phosphate and to harden said binder to the extent that said core can be handled without damage and; water in an amount from 15% to 50% by weight based upon the total weight of boronated aluminum phosphate and water; balance essentially foundry sand; permitting said injected molten metal to solidify along said casting surface to form a die casting; removing said die casting from said mold; and separating said die casting from said core.

2. The method of claim 1, wherein: said foundry sand comprises silica sand and said binder is present in an amount from about 1.0% to 3.5%.

3. The method of claim 1, wherein: said foundry sand comprises zircon sand and said binder is present in an amount from about 0.3% to 1.5%.

4. The method of claim 1, wherein: said sand core hardening agent consists essentially of an alkaline earth material containing alkaline earth metal and an oxide in an amount from 10% to 20% of the weight of said binder.

5. The method of claims 1, 2, 3, or 4, wherein: said core is coated with a coating material having a viscosity sufficient to substantially seal surface porosity on said core and said coating material consists essentially of from 4% to 30% of a suspending agent, from 60% to 95% of a particulate refractory material, from 1% to 10% of a binding agent, and an effective amount of a vehicle for interacting with said suspending agent and said binding agent to achieve a viscosity suitable to obtain a coating thickness and uniformity that leads to good resistance to washout and penetration during die casting.

6. The method of claim 1, wherein: $Fe_2O_3$ is present in said core in an amount from 1% to 4% by weight of foundry said.

7. The method of claims 1, 2, 3, or 4, wherein: said core is coated with a coating material having a viscosity sufficient to substantially seal surface porosity on said core and suitable to obtain a coating thickness and uniformity that leads to good resistance to washout and penetration during die casting and consists essentially of from about 5% to 90% of an organic liquid solvent, from about 0.1% to 2% of a suspending agent, from about 5% to 80% of calcium aluminate particles having an average particle size of 20 to 25 microns and no particles larger than about 70 microns, and a hard resin which is the reaction product of fumaric acid, gum rosin, and pentaerythritol, said resin is within the ratio by weight between about 0.5 and 5 parts per 100 parts of composition, all percentages expressed by weight of composition.

* * * * *